US008382558B2

(12) United States Patent
Watanabe et al.

(10) Patent No.: US 8,382,558 B2
(45) Date of Patent: Feb. 26, 2013

(54) APPARATUS FOR DRESSING A POLISHING PAD, CHEMICAL MECHANICAL POLISHING APPARATUS AND METHOD

(75) Inventors: Katsuhide Watanabe, Tokyo (JP); Ryuichi Kosuge, Tokyo (JP); Soichi Isobe, Tokyo (JP)

(73) Assignee: Ebara Corporation, Tokyo (JP)

( * ) Notice: Subject to any disclaimer, the term of this patent is extended or adjusted under 35 U.S.C. 154(b) by 383 days.

(21) Appl. No.: 12/690,408

(22) Filed: Jan. 20, 2010

(65) Prior Publication Data

US 2010/0190417 A1 Jul. 29, 2010

(30) Foreign Application Priority Data

Jan. 28, 2009 (JP) ..... 2009-016851

(51) Int. Cl.
*B24B 53/02* (2012.01)
*B24B 5/02* (2006.01)

(52) U.S. Cl. ..... 451/443; 451/56; 451/288

(58) Field of Classification Search ..... 451/56, 451/443, 444, 398, 285–289, 8, 72
See application file for complete search history.

(56) References Cited

U.S. PATENT DOCUMENTS

| | | | | |
|---|---|---|---|---|
| 5,081,795 | A | 1/1992 | Tanaka et al. | |
| 5,749,771 | A | 5/1998 | Isobe | |
| 5,916,009 | A * | 6/1999 | Izumi et al. | 451/5 |
| 5,938,884 | A * | 8/1999 | Hoshizaki et al. | 156/345.14 |
| 6,001,008 | A | 12/1999 | Fujimori et al. | |
| 6,093,091 | A * | 7/2000 | Keller | 451/388 |
| 6,110,025 | A * | 8/2000 | Williams et al. | 451/286 |
| 6,217,429 | B1 | 4/2001 | Hoey | |
| 6,435,949 | B1 * | 8/2002 | Katsuoka et al. | 451/59 |
| 6,957,998 | B2 * | 10/2005 | Togawa | 451/8 |
| 2007/0212983 | A1 | 9/2007 | Nangoy et al. | |

FOREIGN PATENT DOCUMENTS

| | | |
|---|---|---|
| JP | 09-314456 | 12/1997 |
| JP | 10-071557 | 3/1998 |
| JP | 11-333698 | 12/1999 |
| JP | 2000-315665 | 11/2000 |
| JP | 4072810 | 7/2002 |
| JP | 3922887 | 9/2002 |
| JP | 2006-272549 | 10/2006 |
| JP | 2006-346859 | 12/2006 |
| JP | 2007-313644 | 12/2007 |
| WO | 99/50022 | 10/1999 |

* cited by examiner

*Primary Examiner* — Dung Van Nguyen
(74) *Attorney, Agent, or Firm* — Wenderoth, Lind & Ponack, L.L.P.

(57) ABSTRACT

An apparatus dresses a polishing pad. The apparatus includes a dresser drive shaft which is rotatable and vertically movable, a dresser flange coupled to the dresser drive shaft and configured to secure a dressing member thereto, a spherical bearing provided in the dresser flange and configured to allow the dressing member to tilt with respect to the dresser drive shaft, and a spring mechanism configured to generate a force against a tilting motion of the dressing member.

10 Claims, 18 Drawing Sheets

$$F/x = K: \ 0.5 \times 10^4 \leqq K \leqq 2 \times 10^4 \ N/m$$

or $$FL^2/x = KL^2 = K\theta: \ 12.5 \leqq K\theta \leqq 50 \ Nm/rad$$

where $K = k1 + k2 + \cdots$

CENTER OF ROTATION
OF POLISHING TABLE

CENTER OF ROTATION
OF POLISHING TABLE $$2 \times 10^4 \text{N/m} < K$$

or $$50 \text{ Nm/rad} < K\theta$$

$$K \leqq 2 \times 10^4 \text{N/m}$$

or $$K\theta \leqq 50 \text{ Nm/rad}$$

APPARATUS FOR DRESSING A POLISHING PAD, CHEMICAL MECHANICAL POLISHING APPARATUS AND METHOD

BACKGROUND OF THE INVENTION

1. Field of the Invention

The present invention relates to an apparatus for dressing a polishing pad used in polishing a workpiece, such as a semiconductor wafer, and more particularly to a dressing apparatus provided in a polishing apparatus for polishing the workpiece to planarize a surface thereof. The present invention also relates to a chemical mechanical polishing apparatus and a chemical mechanical polishing method using such a dressing apparatus.

2. Description of the Related Art

In recent years, semiconductor devices become smaller and smaller, and device structures become more complicated. A surface planarization is a very important process in fabrication of the semiconductor devices. A typical technique used in the surface planarization is chemical mechanical polishing (CMP). In the process of chemical mechanical polishing, a semiconductor wafer is brought into sliding contact with a polishing surface of a polishing pad, while a polishing liquid, containing abrasive grains such as silica ($SiO_2$), is supplied onto the polishing surface, whereby a surface of the semiconductor wafer is polished. A fixed abrasive pad, which is constituted by abrasive grains bonded by a binder, may be used instead of the polishing pad.

The process of chemical mechanical polishing is performed using a CMP apparatus. Typical CMP apparatus includes a polishing table with a polishing pad attached to an upper surface thereof, and a top ring (also referred to as a carrier) for holding a substrate, such as a semiconductor wafer, which is a workpiece to be polished. The polishing table and the top ring are rotated about their own axes respectively, and in this state the top ring presses the substrate against a polishing surface (i.e., an upper surface) of the polishing pad at a predetermined pressure, while the polishing liquid is supplied onto the polishing surface, to thereby polish the substrate to a flat and mirror finish. The polishing liquid to be used is typically composed of an alkali solution and fine abrasive grains (e.g., silica) suspended in the alkali solution. The substrate is polished by a combination of a chemical polishing action by the alkali and a mechanical polishing action by the abrasive grains.

When the substrate is polished, the abrasive grains and polishing debris adhere to the polishing surface of the polishing pad. In addition, characteristics of the polishing pad change and its polishing capability is lowered. Therefore, as polishing of the substrate is repeated, a polishing speed (i.e., a removal rate) is lowered and uneven polishing occurs. Thus, in order to condition the polishing surface of the deteriorated polishing pad, a dressing apparatus is provided adjacent to the polishing table.

The dressing apparatus typically has a rotatable dresser head and a dressing member secured to the dresser head. The dressing apparatus is configured to press the dressing member against the polishing surface of the polishing pad on the rotating polishing table, while rotating the dresser head about its own axis, to thereby remove the abrasive grains and the polishing debris from the polishing surface of the polishing pad and planarize and condition (i.e., dress) the polishing surface. Generally, the dressing member to be used has diamond particles electrodeposited on a surface thereof (i.e., a dressing surface) to be brought into contact with the polishing surface.

There are two ways of dressing the polishing surface of the polishing pad using the above-described dressing apparatus: one is a way of dressing the polishing surface concurrently with polishing of the substrate; and the other is a way of dressing the polishing surface during an interval between the polishing processes of the substrates. In both ways, a certain amount of the polishing surface is scraped off by dressing. However, due to the complexity of generating a vertical and horizontal force toward a dresser when dressing, it is difficult to control a dressing load while avoiding an unacceptable fluctuation of an attitude of the dresser. The improvement of the apparatus for dressing a polishing surface has been awaited.

SUMMARY OF THE INVENTION

The present invention has been made in view of the above. It is therefore an object of the present invention to provide an apparatus capable of dressing a polishing pad appropriately and preventing an unwanted dressing load. Further, it is another object of the present invention to provide a chemical mechanical polishing apparatus and a chemical mechanical polishing method using such a dressing apparatus.

One aspect of the present invention for achieving the above object is to provide an apparatus for dressing a polishing pad. The apparatus includes: a dresser drive shaft which is rotatable and vertically movable; a dresser flange coupled to the dresser drive shaft and configured to secure a dressing member thereto which is to be brought into sliding contact with the polishing pad; a spherical bearing provided in the dresser flange and configured to allow the dressing member to tilt with respect to the dresser drive shaft; and a spring mechanism configured to generate a force against a tilting motion of the dressing member.

In a preferred aspect of the present invention, the spring mechanism is configured to act as a spring having a spring constant in a range of $0.5\times10^4$ N/m to $2\times10^4$ N/m. Alternatively, the spring mechanism is configured to allow the dressing member to have a tilting rigidity in a range of 12.5 Nm/rad to 50 Nm/rad.

In a preferred aspect of the present invention, the dresser flange has an upper dresser flange secured to the dresser drive shaft and a lower dresser flange to which the dressing member is secured; and the spherical bearing couples the upper dresser flange and the lower dresser flange to each other while allowing the upper dresser flange and the lower dresser flange to tilt with respect to each other.

In a preferred aspect of the present invention, the upper dresser flange is made of elastic material, and the upper dresser flange serves as the spring mechanism.

In a preferred aspect of the present invention, the apparatus further includes a seal member provided between the upper dresser flange and the lower dresser flange. The spherical bearing is located in a space formed between the upper dresser flange and the lower dresser flange, and the space is sealed by the seal member.

In a preferred aspect of the present invention, the apparatus further includes a torque transmission member configured to transmit a torque of the dresser drive shaft to the dressing member.

In a preferred aspect of the present invention, the spherical bearing includes a spherical protrusion provided on a circumferential surface of the dresser drive shaft and a spherical recess member provided on the dresser flange.

In a preferred aspect of the present invention, the dressing member is removably attached to the dresser flange.

In a preferred aspect of the present invention, the apparatus further includes a cover arranged so as to surround at least part of the dresser flange.

Another aspect of the present invention is to provide a chemical mechanical polishing apparatus including: a polishing table for supporting a polishing pad; a top ring unit configured to press a workpiece against the polishing pad while rotating the workpiece; a device configured to supply a polishing liquid onto the polishing pad; and the above-described apparatus for dressing the polishing pad.

Still another aspect of the present invention is to provide a chemical mechanical polishing method including polishing a workpiece using the above-described chemical mechanical polishing apparatus.

Still another aspect of the present invention is to provide an apparatus for dressing a polishing pad. The apparatus includes: a dresser drive shaft which is rotatable and vertically movable; a dresser flange coupled to the dresser drive shaft and configured to secure a dressing member thereto; and a mechanism configured to generate a force against a tilting motion of the dressing member, wherein the dresser flange has a magnet, and the dressing member is attached to the dresser flange by a magnetic force acting between the dressing member and the magnet.

According to the present invention, the dresser flange performs a gimbal motion so as to follow a polishing pad (having an uneven pattern), even if the polishing pad is rotating during dressing. This results in the control of the width of the fluctuation of vertical movement of the dresser when dressing, avoiding an acceptable fluctuation of an attitude of the dresser. Therefore, even when dressing is performed with a low load, the polishing pad can be dressed with little partial wear of the pad. Further, according to the present invention, because the dressing load can be reduced, an amount of the polishing pad scraped off during dressing can be as small as possible, and hence a life of the polishing pad (or fixed abrasive pad) can be increased. Therefore, a running cost of the chemical mechanical polishing apparatus can be reduced. Further, according to the present invention, maintenance of the dresser is made much easier.

DETAILED DESCRIPTION OF THE PREFERRED EMBODIMENTS

Embodiments of the present invention will be described below with reference to the drawings.

Figure 1:
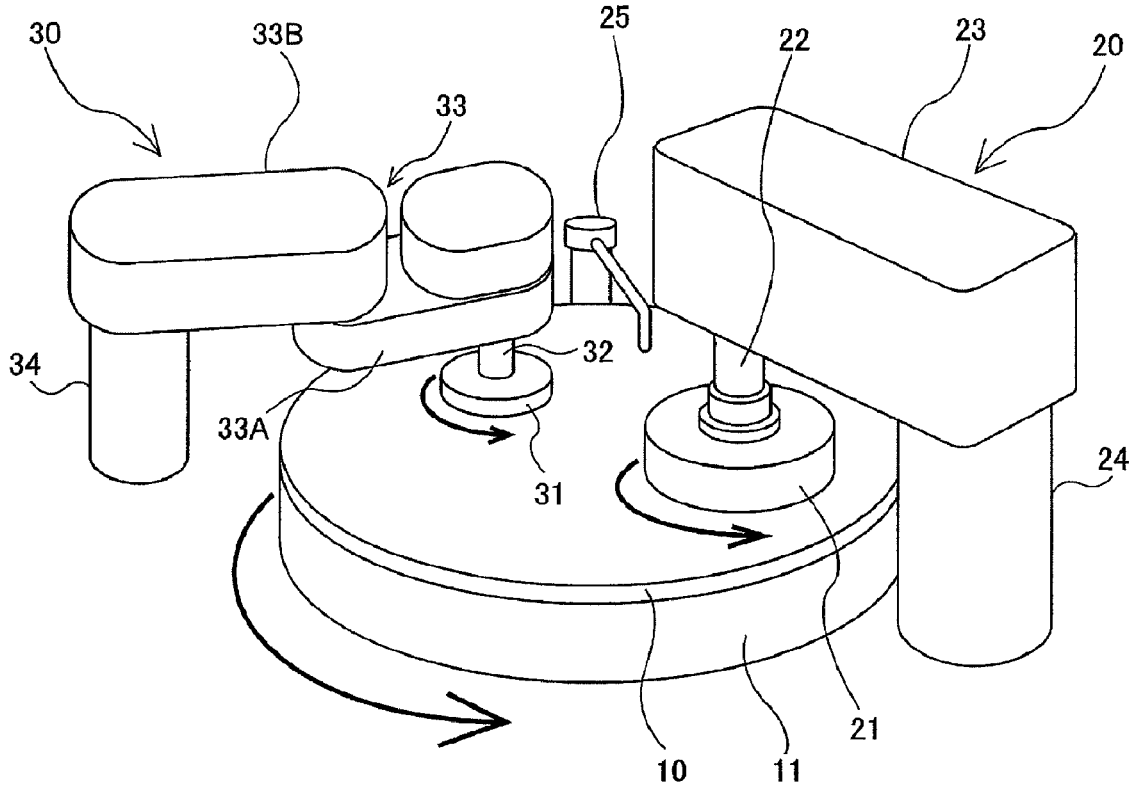
FIG. 1 is a perspective view of a polishing section of a CMP apparatus.

FIG. 1 shows a perspective view showing a polishing section of a CMP apparatus. The polishing section includes a polishing table 11 (in other words, a platen) supporting a polishing pad 10. A top ring unit 20 is configured to polish a substrate (i.e., a workpiece), such as a wafer, by bringing it into sliding contact with the polishing pad 10, and a dressing unit (dressing apparatus) 30 is configured to condition (i.e., dress) an upper surface of the polishing pad 10. The polishing pad 10 is attached to an upper surface of the polishing table 11, and the upper surface of the polishing pad 10 provides a polishing surface. Preferably, the polishing table 11 is coupled to a motor (not shown), so that the polishing table 11 and the polishing pad 10 are rotated by the motor in a direction indicated by arrow.

The top ring unit 20 includes a top ring head 21 configured to hold the substrate and press it against the upper surface of the polishing pad 10, a top ring drive shaft 22 coupled to the top ring head 21, and a top ring swing arm 23 rotatably holding the top ring drive shaft 22. The top ring swing arm 23 is supported by a top ring swing shaft 24. A motor (not shown) is installed in the top ring swing arm 23 and this motor is coupled to the top ring drive shaft 22. Alternatively, the motor can be installed outside the top ring swing arm 23. Rotation of this motor is transmitted to the top ring head 21 via the top ring drive shaft 22, whereby the top ring head 21 is rotated about the top ring drive shaft 22 in a direction indicated by arrow.

A liquid supply mechanism 25 (or, a device for supplying a liquid) for supplying a polishing liquid and a dressing liquid onto the polishing surface of the polishing pad 10 is provided adjacent to the top ring unit 20. This liquid supply mechanism 25 has plural supply nozzles from which the polishing liquid and the dressing liquid are supplied onto the polishing surface of the polishing pad 10. The liquid supply mechanism 25 serves as both a polishing-liquid supply mechanism for supplying the polishing liquid onto the polishing pad 10 and a dressing-liquid supply mechanism for supplying the dressing liquid (e.g., pure water) onto the polishing pad 10. The polishing-liquid supply mechanism and the dressing-liquid supply mechanism may be provided separately.

The top ring head 21 has a lower surface that provides a substrate-holding surface for holding the substrate by a vacuum suction or the like. The top ring drive shaft 22 is coupled to a non-illustrated vertical actuator (e.g., an air cylinder). With this configuration, the top ring head 21 is elevated and lowered by the vertical actuator via the top ring drive shaft 22.

Polishing of the substrate is performed as follows. The substrate is held on the lower surface of the top ring head 21, and then the top ring head 21 and the polishing table 11 are rotated. In this state, the polishing liquid is supplied onto the polishing surface of the polishing pad 10, and then the top ring head 21 presses the substrate against the polishing surface of the polishing pad 10. A surface (a lower surface) of the substrate is polished by the mechanical polishing action of abrasive grains contained in the polishing liquid and the chemical polishing action of the polishing liquid. The top ring swing shaft 24 is located radially outwardly of the polishing pad 10. This top ring swing shaft 24 is configured to rotate, so that the top ring head 21 can move between a polishing position on the polishing pad 10 and a standby position outside the polishing pad 10. Apparatus for chemical-mechanical polishing (CMP) head having direct pneumatic wafer polishing apparatus is described in U.S. Pat. No. 7,029,382 and now entitled in Ebara Corporation; substrate holding apparatus and substrate polishing apparatus are described in U.S. Pat. No. 6,890,402 and entitled in Ebara Corporation; each of which is hereby incorporated by reference.

The dressing unit (dressing apparatus) 30 includes a dresser 31 to be brought into sliding contact with the polishing surface of the polishing pad 10, a dresser drive shaft 32 coupled to the dresser 31, and a dresser swing arm 33 rotatably holding the dresser drive shaft 32. A lower surface of the dresser 31 provides a dressing surface to be brought into sliding contact with the polishing surface of the polishing pad 10. Abrasive grains, such as diamond particles, are fixed to the dressing surface. The dresser swing arm 33 is supported by a dresser swing shaft 34. A motor (not shown) is installed in the dresser swing arm 33 and this motor is coupled to the dresser drive shaft 32. Rotation of this motor is transmitted to the dresser 31 via the dresser drive shaft 32, whereby the dresser 31 is rotated about the dresser drive shaft 32 in a direction indicated by arrow.

The dresser swing arm 33 is an articulated arm constituted by a first arm 33A and a second arm 33B. The above-described motor for rotating the dresser drive shaft 32 is provided in the first arm 33A. A swing motor (not shown) for rotating the first arm 33A about a joint axis of the arms through a predetermined angle is installed in the second arm 33B. When the swing motor is set in motion, the dresser 31 moves on the polishing surface of the polishing pad 10 in substantially a radial direction of the polishing surface.

Figure 2:
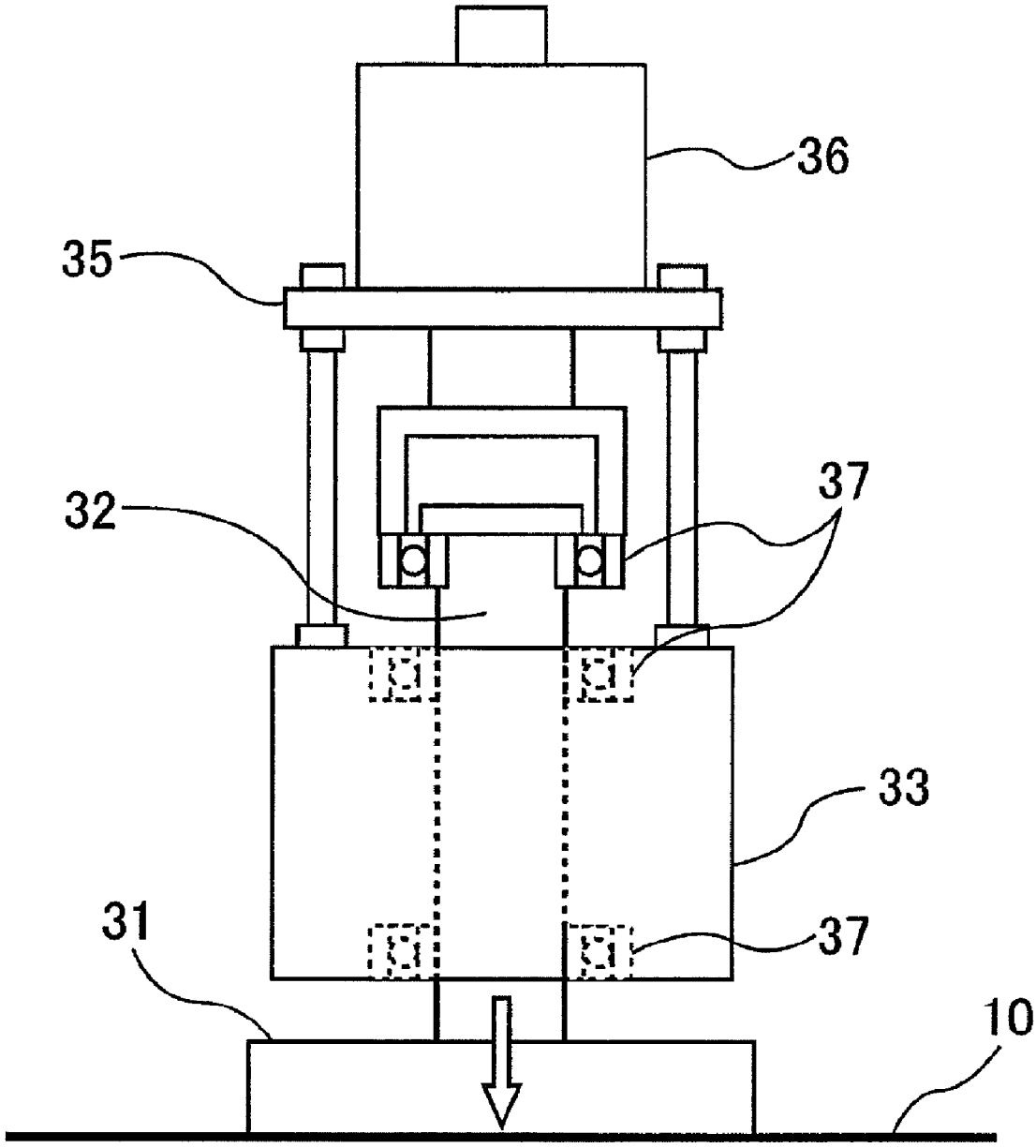
FIG. 2 is a front view schematically showing an example of a loading mechanism of a dressing apparatus.

FIG. 2 is a front view schematically showing an example of a loading mechanism of the dressing unit 30. As shown in FIG. 2, the dresser drive shaft 32 is rotatably supported by plural bearings 37. A support base 35 is secured to an upper portion of the dresser swing arm 33 (the first arm 33A), and an air cylinder 36, which is a vertical actuator, is mounted on the support base 35. An upper end of the dresser drive shaft 32 is coupled to the air cylinder 36. The dresser 31 is pressed against the polishing surface of the polishing pad 10 by the air cylinder 36 via the dresser drive shaft 32.

Figure 3:
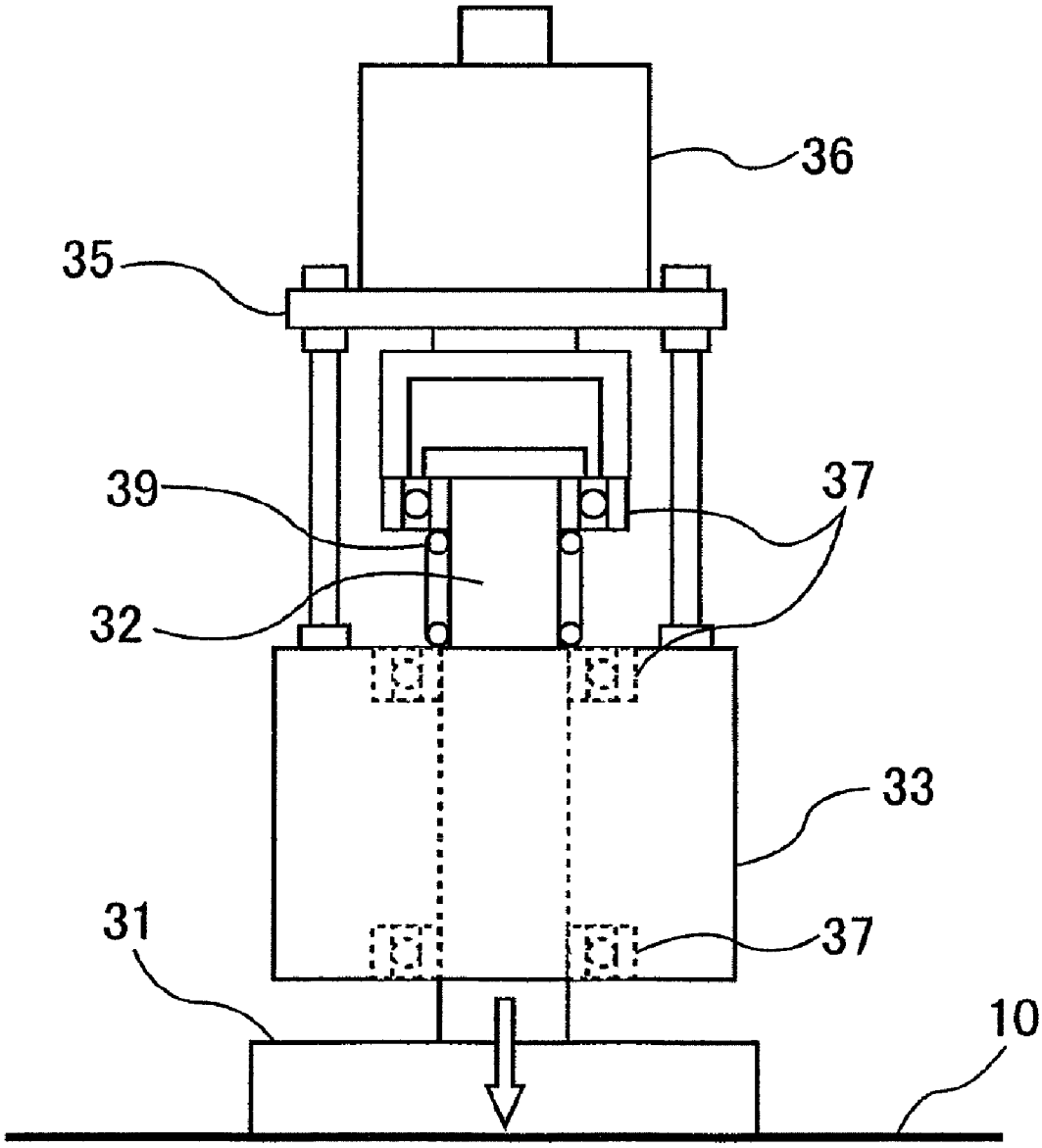
FIG. 3 is a front view schematically showing another example of the loading mechanism of the dressing apparatus.

FIG. 3 is a front view schematically showing another example of the loading mechanism of the dressing unit 30. The loading mechanism shown in FIG. 3 has basically the same structures as those of the loading mechanism shown in FIG. 2, but is different in that a spring 39 biasing the dresser drive shaft 32 upwardly is provided. This spring 39 is disposed on the upper portion of the dresser swing arm 33, and an upper end portion of the dresser drive shaft 32 is forced upwardly by the spring 39. In this example, when pressing the dresser 31 against the polishing pad 10, the air cylinder 36 forces the dresser drive shaft 32 downwardly against the upward force of the spring 39. While the present invention can use either loading mechanism, it is preferable to use the loading mechanism having the spring that can achieve less hysteresis from the viewpoint of realizing low-load dressing.

When dressing the polishing surface of the polishing pad 10, the motor rotates the dresser 31, and subsequently the air cylinder 36 moves the dresser 31 downwardly to bring the dressing surface of the dresser 31 into sliding contact with the polishing surface of the rotating polishing pad 10. In this state, the dresser 31 is swung in substantially the radial direction of the polishing pad 10. This movement (i.e., swinging movement) of the rotating dresser 31 can remove the debris and the like adhering to the polishing surface of the polishing pad 10 and can restore the polishing surface. During dressing, the liquid supply mechanism 25 supplies the dressing liquid (e.g., pure water) onto the polishing surface of the polishing pad 10. The dresser swing shaft 34 is located radially outwardly of the polishing pad 10. This dresser swing shaft 34 is configured to rotate, so that the dresser 31 can move between a dressing position on the polishing pad 10 and a standby position outside the polishing pad 10. Dressing of the polishing pad 10 by the dressing unit 30 may be performed concurrently with polishing of the substrate. When plural substrates are to be polished successively, dressing of the polishing pad 10 may be performed in intervals between the polishing processes.

Figure 4:
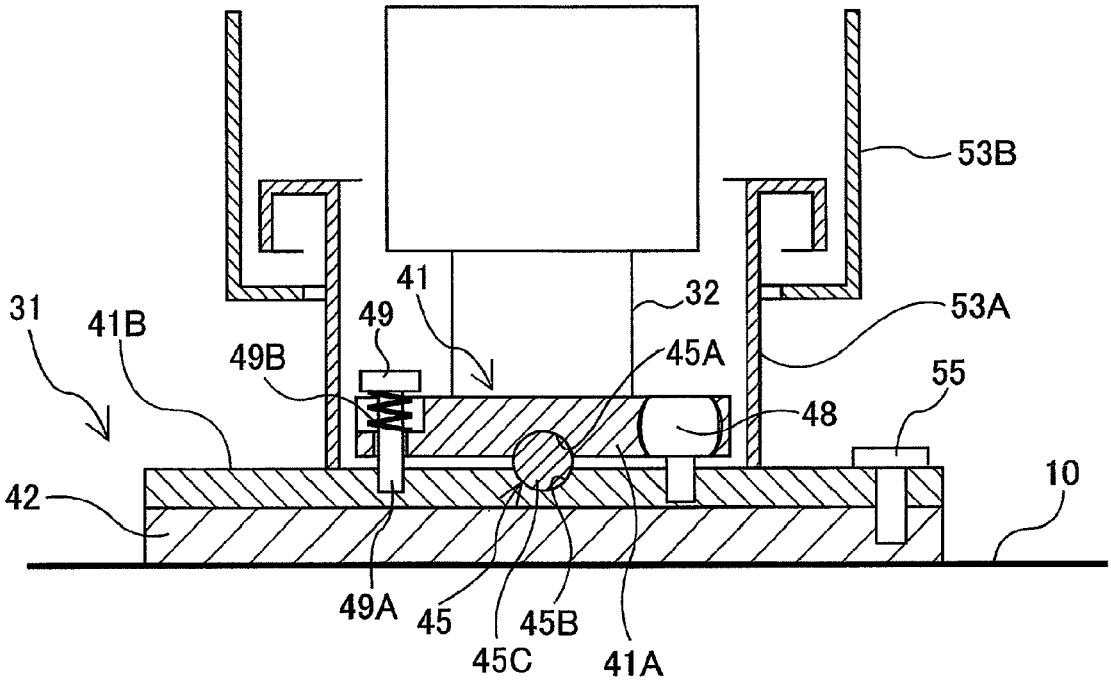
FIG. 4 is a cross-sectional view showing an essential part of the apparatus for dressing a polishing pad according to a first embodiment of the present invention.
Figure 5:
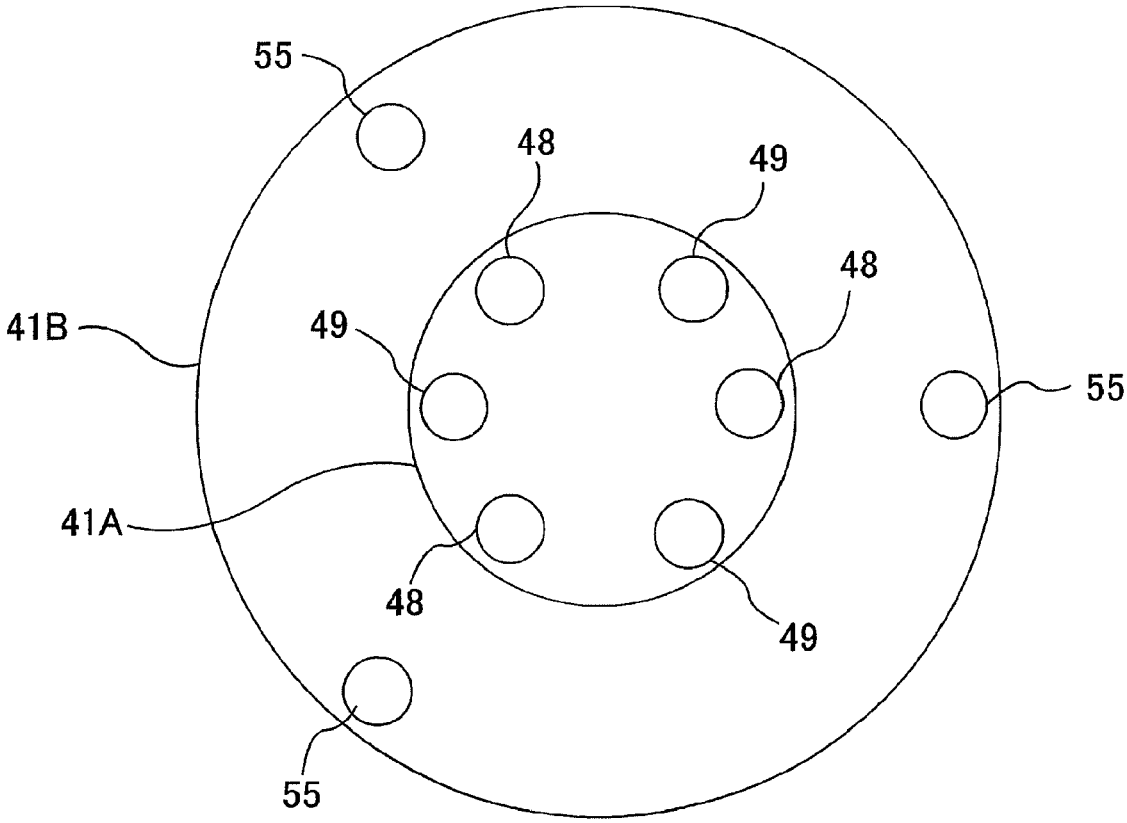
FIG. 5 is a plan view showing part of the dressing apparatus shown in FIG. 4.

FIG. 4 is a cross-sectional view showing an essential part of the dressing unit (dressing apparatus) according to a first embodiment of the present invention. FIG. 5 is a plan view showing part of the dressing unit shown in FIG. 4. As shown in FIG. 4, the dresser 31 has a dresser flange 41 including a disk-shaped upper dresser flange 41A and a disk-shaped lower dresser flange 41B, and a dresser disk (dressing member) 42. The upper dresser flange 41A has a smaller diameter than that of the lower dresser flange 41B. The lower dresser flange 41B has a diameter equal to a diameter of the dresser disk 42. A small clearance is formed between the upper dresser flange 41A and the lower dresser flange 41B. An upper surface of the dresser disk 42 is fixed to a lower surface of the lower dresser flange 41B. The dresser disk 42 has a lower surface that provides the above-described dressing surface. The upper dresser flange 41A and the lower dresser flange 41B are made of the same material. Examples of the material to be preferably used include metal, such as stainless steel.

The dresser disk 42 and the dresser drive shaft 32 are coupled to each other via the upper dresser flange 41A, the lower dresser flange 41B, and a spherical bearing 45. The upper dresser flange 41A is secured to a lower end of the dresser drive shaft 32. The spherical bearing 45 is located between the upper dresser flange 41A and the lower dresser flange 41B, and is configured to allow the upper dresser flange 41A and the lower dresser flange 41B to tilt with respect to each other. This spherical bearing 45 transmits a thrust load and a radial load from the dresser drive shaft 32 to the lower dresser flange 41B and the dresser disk 42, while permitting tilting of the dresser disk 42 with respect to the dresser drive shaft 32.

The spherical bearing 45 has a spherical recess 45A formed on the lower surface of the upper dresser flange 41A, a spherical recess 45B formed on the upper surface of the lower dresser flange 41B, and a ball 45C slidably engaging with the spherical recesses 45A and 45B. The spherical recess 45A faces downwardly and the spherical recess 45B faces upwardly. The ball 45C is made of a material having an excellent wear resistance, such as ceramic. The spherical recesses 45A and 45B and the ball 45C are arranged on a central axis of the dresser drive shaft 32. In this embodiment, the spherical recesses 45A and 45B are formed on the upper dresser flange 41A and the lower dresser flange 41B. Instead, two receiving members each having a spherical recess may be provided on the upper dresser flange 41A and the lower dresser flange 41B, respectively.

The upper dresser flange 41A and the lower dresser flange 41B are coupled to each other by plural torque transmission pins (torque transmission members) 48. These torque transmission pins 48 are arranged around the spherical bearing 45 (i.e., around the central axis of the dresser drive shaft 32 and the dresser disk 42) at equal intervals. The torque transmission pins 48 transmit a torque of the dresser drive shaft 32 to the dresser disk 42, while permitting tiling of the dresser disk 42 with respect to the dresser drive shaft 32.

Figure 6:
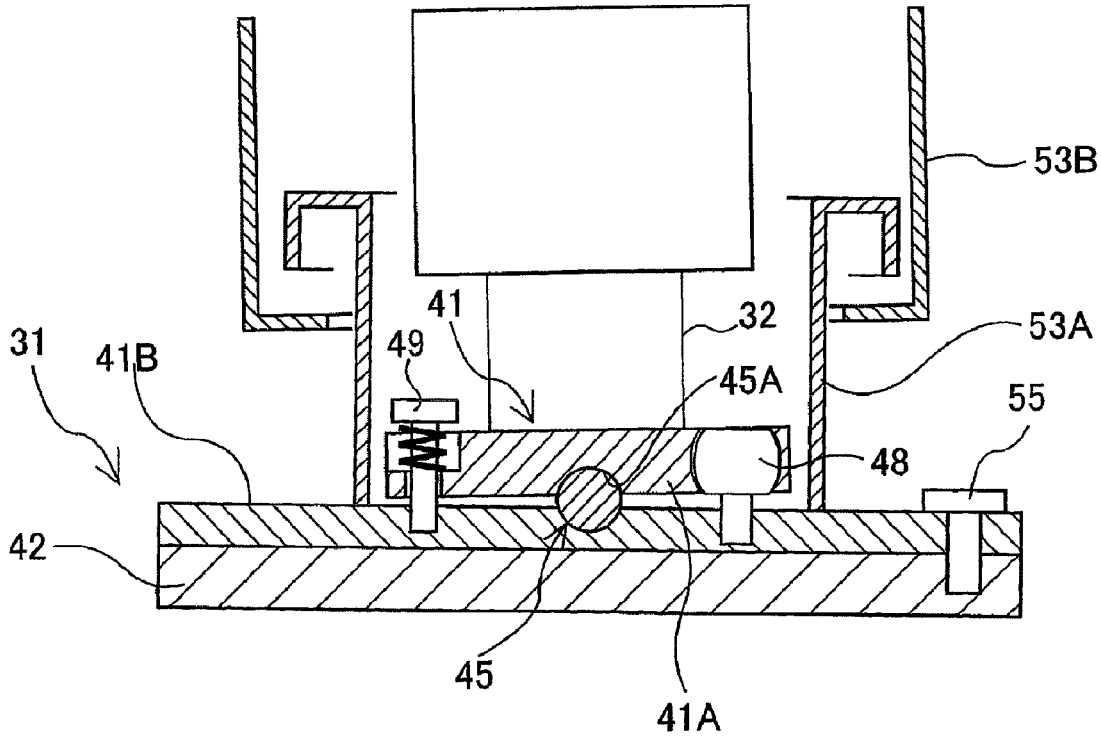
FIG. 6 is a view showing a state in which a lower dresser flange tilts with respect to an upper dresser flange.

FIG. 6 is a view showing a state in which the lower dresser flange tilts with respect to the upper dresser flange. Each torque transmission pin 48 has a spherical sliding surface, which loosely engages with a receiving hole formed in the upper dresser flange 41A. A slight clearance is formed between the sliding surface of the torque transmission pin 48 and the receiving hole of the upper dresser flange 41A. When the lower dresser flange 41B tilts with respect to the upper dresser flange 41A, the torque transmission pins 48 also tilt in unison with the lower dresser flange 41B, while maintaining engagement with the upper dresser flange 41A.

The torque transmission pins 48 do not transmit the thrust load from the dresser drive shaft 32 to the dresser disk 42, and transmit only the torque of the dresser drive shaft 32 to the lower dresser flange 41B and the dresser disk 42. In this embodiment, the torque transmission pins 48 are secured to the lower dresser flange 41B. The torque transmission pins 48 may be secured to the upper dresser flange 41A. With the above-described configurations, the dresser disk 42 and the lower dresser flange 41B can perform a gimbal motion about a center of the ball 45C, and the torque of the dresser drive shaft 32 can be transmitted to the dresser disk 42 via the torque transmission pins 48 without restricting the gimbal motion.

The upper dresser flange 41A and the lower dresser flange 41B are further coupled to each other by plural spring mechanisms 49. These spring mechanisms 49 are arranged around the spherical bearing 45 (i.e., around the central axis of the dresser drive shaft 32 and the dresser disk 42) at equal intervals. Each spring mechanism 49 has a rod 49A and a spring 49B. The rod 49A is secured to the lower dresser flange 41B and extends through the upper dresser flange 41A. The rod 49A has a collar formed at its upper end. The spring 49B is disposed between the collar of the rod 49A and the upper surface of the upper dresser flange 41A. The spring mechanisms 49 generate a force against tilting of the dresser disk 42 and the lower dresser flange 41B to recover the dresser disk 42 to its original position (attitude).

The above-described configurations enable the dresser disk 42 and the lower dresser flange 41B to perform the gimbal motion with its fulcrum on the center of the ball 45C. During dressing, the dresser disk 42 tilts so as to follow a shape of the polishing surface of the polishing pad 10, which is rotating during the process of dressing. Therefore, with a lessened load, the dresser disk 42 can attain a satisfactory result of dressing. Further, since the fulcrum of the tilting motion of the dresser disk 42 (i.e., a position of the center of the spherical bearing 45 from the polishing surface) is low, the dresser disk 42 can smoothly follow undulations of the polishing surface of the polishing pad 10. Therefore, the dresser disk 42 is unlikely to receive a force of moment resulting from a frictional force of the polishing surface. As a result, the dresser disk 42 can dress the polishing surface of the polishing pad 10 without being inclined excessively. Further, because the tilting motion of the dresser disk 42 can prevent partial wear of the polishing pad 10, low-load dressing can be realized.

As shown in FIG. 4, a first cover 53A in a cylindrical shape is secured to the upper surface of the lower dresser flange 41B. This first cover 53A is shaped so as to surround the upper dresser flange 41A, the spherical bearing 45, the torque transmission pins 48, the spring mechanisms 49, and the lower end of the dresser drive shaft 32. Further, a second cover 53B is provided so as to surround an upper end of the first cover 53A. This second cover 53B is secured to the dresser swing arm 33 (see FIG. 1), and arranged so as to cover the upper end of the first cover 53A and the dresser drive shaft 32. A clearance is formed between the first cover 53A and the second cover 53B, so that the first cover 53A does not contact the second cover 53B when the first cover 53A is inclined in unison with the tilting motion of the lower dresser flange 41B and the dresser disk 42. The first cover 53A and the second cover 53B can prevent the dressing liquid and the polishing liquid from contacting the ball 45C of the spherical bearing 45 and can further prevent particles, generated from sliding elements (such as the torque transmission pins 48), from falling onto the polishing pad 10.

The dresser disk 42 is removably attached to the lower dresser flange 41B. More specifically, the dresser disk 42 is mounted on the lower surface of the lower dresser flange 41B by at least three fixing screws 55 (FIG. 5 shows three fixing screws 55). The dresser disk 42 can be removed by removing the fixing screws 55 and can be replaced with a new dresser disk.

Figure 7:
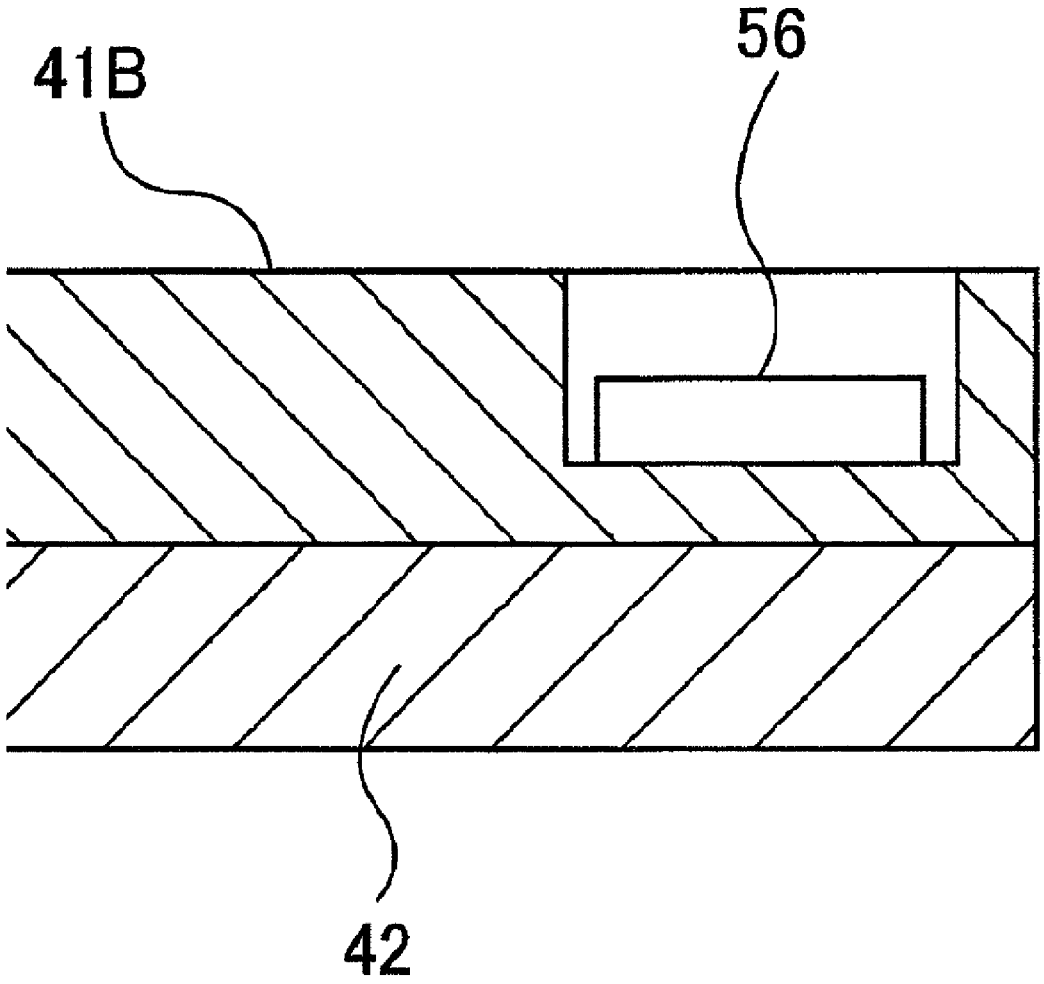
FIG. 7 is an enlarged cross-sectional view showing part of another example of the dressing apparatus.

In a case where the dresser disk 42 is made of magnetic material, such as iron or some other metal, it is possible to use plural magnets 56 as shown in FIG. 7, instead of the fixing screws 55, for securing the dresser disk 42 to the lower dresser flange 41B. In this case, it is preferable to form recesses on the upper surface of the lower dresser flange 41B and place the magnets in the recesses.

Figure 8:
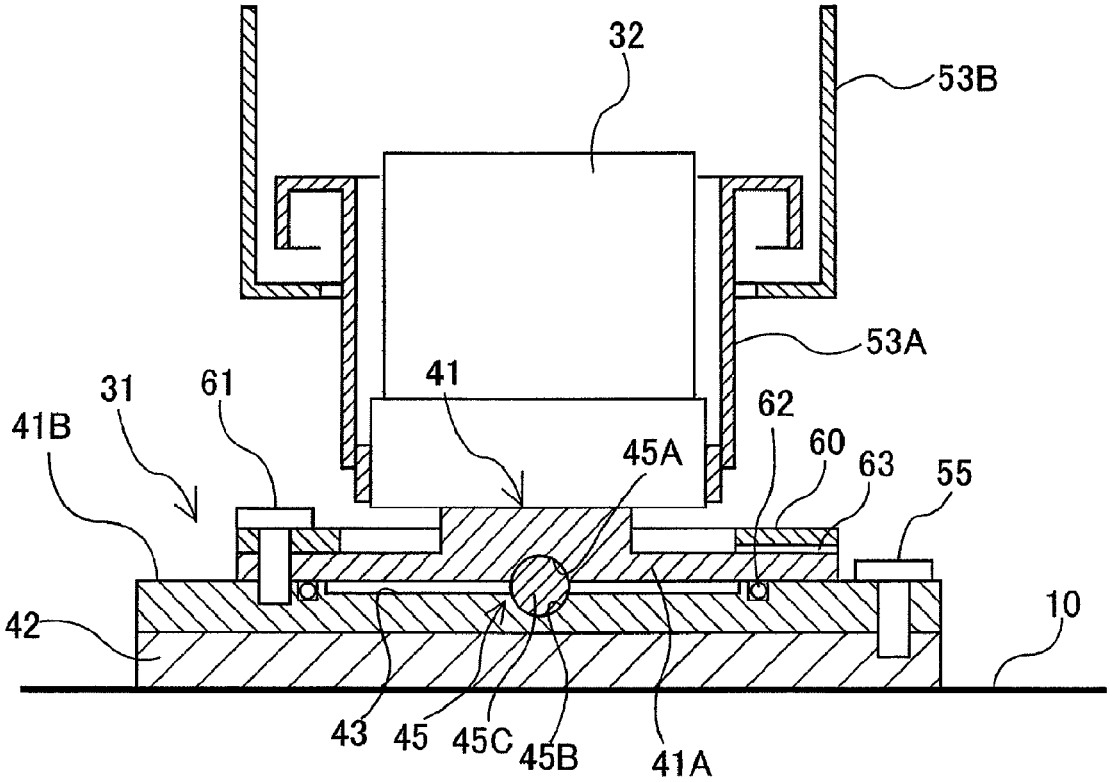
FIG. 8 is a cross-sectional view showing an essential part of the apparatus for dressing a polishing pad according to a second embodiment of the present invention.

FIG. 8 is a cross-sectional view showing an essential part of the dressing unit (dressing apparatus) according to a second embodiment of the present invention. Structures and operations in this embodiment, which are not described in particular, are identical to those in the first embodiment, and repetitive descriptions will be omitted.

The dressing unit 30 according to the present embodiment does not have the above-described spring mechanisms 49 and torque transmission pins 48. In this embodiment, the upper dresser flange 41A functions as the spring mechanisms and the torque transmission members. Specifically, the upper dresser flange 41A is made of elastic material (e.g., resin) and acts as a flat spring. Examples of the elastic material to be preferably used include acetal resin (POM) having excellent mechanical strength, chemical thermal characteristics, and processability. The upper dresser flange 41A has a diameter larger than that of the upper dresser flange according to the first embodiment. The upper dresser flange 41A is secured to the upper surface of the lower dresser flange 41B by an annular flange plate 60 and screws 61.

A circular recess 43 is formed on the upper surface of the lower dresser flange 41B. The circular recess 43 is concentric with the lower dresser flange 41B, and has a diameter smaller than that of the upper dresser flange 41A. An outer diameter of the annular flange plate 60 is substantially equal to the diameter of the upper dresser flange 41A, and an inner diameter of the annular flange plate 60 is equal to or slightly smaller than the diameter of the circular recess 43 formed on the upper surface of the lower dresser flange 41B. Therefore, only a periphery of the upper dresser flange 41A is held by the flange plate 60 and the lower dresser flange 41B, so that the flange plate 60 and the lower dresser flange 41B do not prevent an elastic deformation of the upper dresser flange 41A. The flange plate 60, the upper dresser flange 41A, the lower dresser flange 41B, and the dresser disk 42 may have the same diameter. The spherical bearing 45 has the same structure as that in the first embodiment. The lower end of the first cover 53A is secured to a circumferential surface of the dresser drive shaft 32. The structure of the second cover 53B and a positional relationship between the first cover 53A and the second cover 53B are identical to those in the first embodiment.

In order not to retain a liquid (e.g., the dressing liquid) on the upper surface of the upper dresser flange 41A, at least one radially-extending groove 63 is formed between the upper dresser flange 41A and the flange plate 60. This groove 63 is formed on at least one of the lower surface of the flange plate 60 and the upper surface of the upper dresser flange 41A.

An O-ring (seal member) 62 is provided on the upper surface of the lower dresser flange 41B so as to surround the circular recess 43. The upper dresser flange 41A and the recess 43 define a space, which is hermetically sealed by the O-ring 62. Since the spherical bearing 45 is located in this space, the dressing liquid, the polishing liquid, the polishing debris, and the like do not contact the spherical bearing 45. Therefore, lubricity of the spherical bearing 45 can be maintained. The O-ring 62 may be attached to the lower surface of the upper dresser flange 41A. Further, the recess 43 may be formed on the lower surface of the upper dresser flange 41A.

In this embodiment, the upper dresser flange 41A serves as the spring mechanisms and the torque transmission members, as described above. Specifically, when the dresser disk 42 and the lower dresser flange 41B tilt with respect to the dresser drive shaft 32, the upper dresser flange 41A is deformed elastically. This elastic deformation of the upper dresser flange 41A allows the dresser disk 42 to tilt so as to follow the shape of the polishing surface of the polishing pad 10 during dressing.

Figure 9:
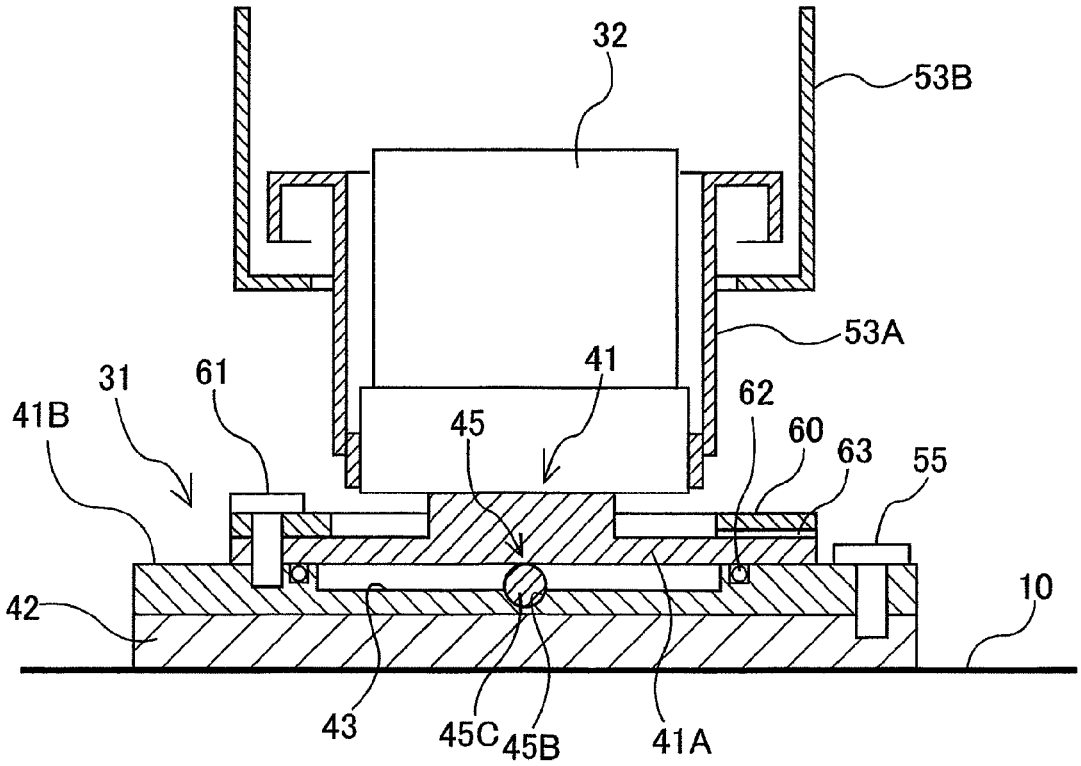
FIG. 9 is a cross-sectional view showing a modified example of the dressing apparatus according to the second embodiment of the present invention.

FIG. 9 is a cross-sectional view showing a modified example of the dressing unit (dressing apparatus) according to the second embodiment of the present invention. In this example, the upper dresser flange 41A has a flat lower surface, and the spherical recess 45A is not formed on the upper dresser flange 41A. The ball 45C is supported by the spherical recess 45B formed on the upper surface of the lower dresser flange 41B. In this example also, the spherical bearing 45 can transmit the thrust load from the upper dresser flange 41A to the lower dresser flange 41B, while permitting tilting of the lower dresser flange 41B and the dresser disk 42. In this example, positioning pins (not shown) are used to align a central axis of the upper dresser flange 41A and a central axis of the lower dresser flange 41B with each other.

Figure 10:
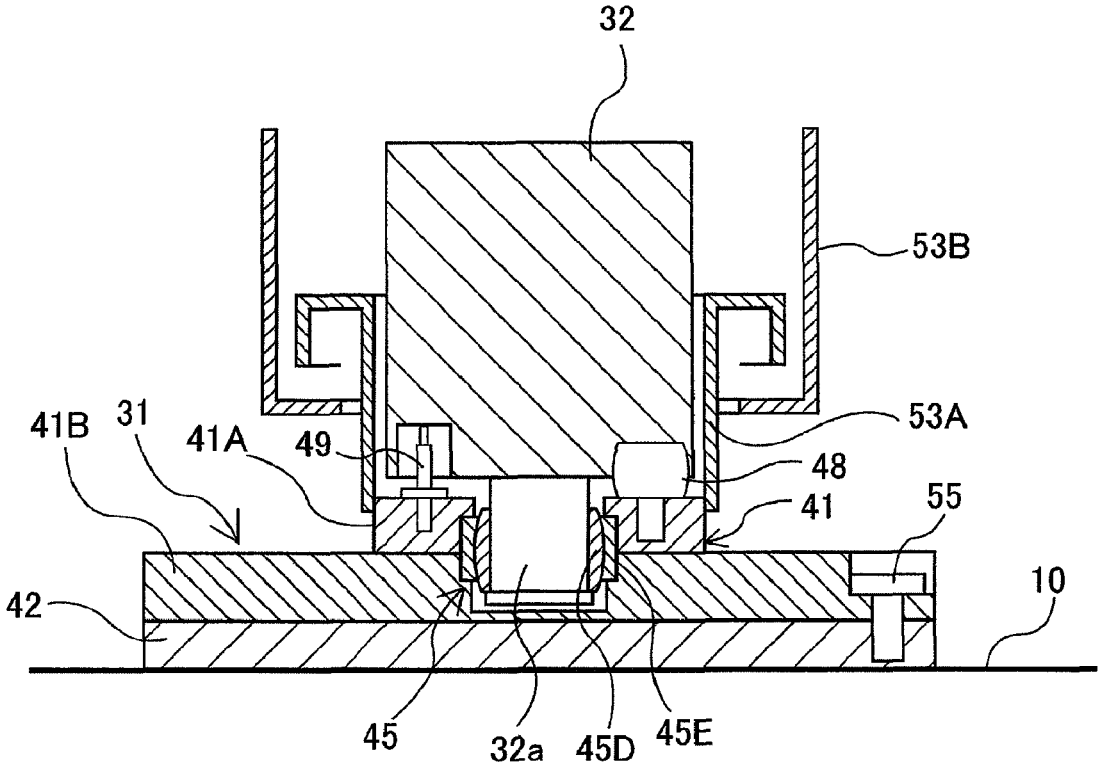
FIG. 10 is a cross-sectional view showing an essential part of the apparatus for dressing a polishing pad according to a third embodiment of the present invention.

FIG. 10 is a cross-sectional view showing an essential part of the dressing unit (dressing apparatus) according to a third embodiment of the present invention. Structures and operations in this embodiment, which are not described in particular, are identical to those in the first embodiment, and repetitive descriptions will be omitted.

The dresser drive shaft 32 has a small-diameter portion 32*a* at its lower end. The lower surface of the upper dresser flange 41A and the upper surface of the lower dresser flange 41B are fixed to each other, so that they constitute a single dresser flange. The upper dresser flange 41A and the lower dresser flange 41B have concentric holes formed therein, and the small-diameter portion 32*a* of the dresser drive shaft 32 is contained in these holes. The upper dresser flange 41A and the lower dresser flange 41B are tiltably coupled to the small-diameter portion 32*a* of the dresser drive shaft 32 via spherical bearing 45. More specifically, a spherical protrusion 45D is secured to a circumferential surface of the small-diameter portion 32*a*, and a spherical recess member 45E is secured to inner circumferential surfaces of the holes. The spherical protrusion 45D and the spherical recess member 45E slidably engage with each other.

Plural spring pins 49, which serve as spring mechanisms, are secured to the upper surface of the upper dresser flange 41A. FIG. 10 shows only one spring pin 49. The spring pins 49 are arranged around the spherical bearing 45 (i.e., around the central axis of the dresser drive shaft 32 and the dresser disk 42) at equal intervals. The spring pins 49 are configured to press the dresser drive shaft 32 upwardly. The upper dresser flange 41A and the dresser drive shaft 32 are coupled to each other via the plural torque transmission pins 48. The lower end of the first cover 53A is secured to the circumferential surface of the upper dresser flange 41A. The structure of the second cover 53B and the positional relationship between the first cover 53A and the second cover 53B are identical to those in the first embodiment.

In this embodiment, the upper dresser flange 41A, the lower dresser flange 41B, and the dresser disk 42 are configured to be tiltable in unison with respect to the dresser drive shaft 32. Therefore, the dresser disk 42 can tilt according to the shape of the polishing surface of the polishing pad 10 during dressing.

Figure 11:
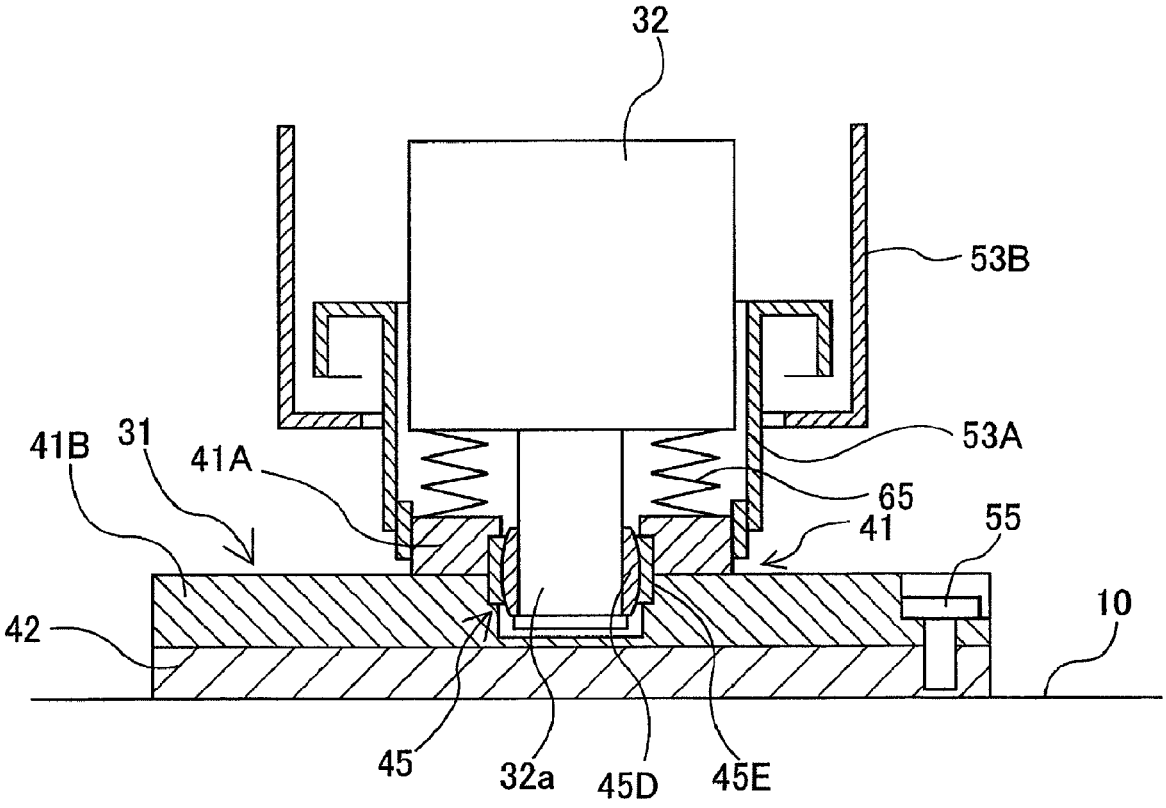
FIG. 11 is a cross-sectional view showing an essential part of a dressing apparatus according to a reference example of the present invention.

FIG. 11 is a cross-sectional view showing an essential part of a dressing apparatus according to a reference example of the present invention. Structures and operations in this example, which are not described in particular, are identical to those in the third embodiment, and repetitive descriptions will be omitted.

The dressing unit 30 in this example does not have the above-described spring mechanisms and the torque transmission pins, but has a bellows 65 connecting the lower end of the dresser drive shaft 32 and the upper surface of the upper dresser flange 41A. This bellows 65 transmits the torque of the dresser drive shaft 32 to the upper dresser flange 41A (i.e., the dresser disk 42).

If the dresser disk 42 does not follow the polishing surface of the polishing pad 10 smoothly, partial wear of the polishing pad 10 can occur. In the reference example shown in FIG. 11, since the bellows 65 is relatively hard, dressing of the polishing pad 10 may not be performed appropriately depending on the surface conditions of the polishing pad 10. In such a case, it is preferable to use the first to third embodiments. The first embodiment and the second embodiment are more advantageous than the third embodiment from the structural viewpoint in that the fulcrum of the tilting motion of the dresser disk 42 (i.e., the position of the center of the spherical bearing 45 from the polishing surface) can be low.

Figure 12:
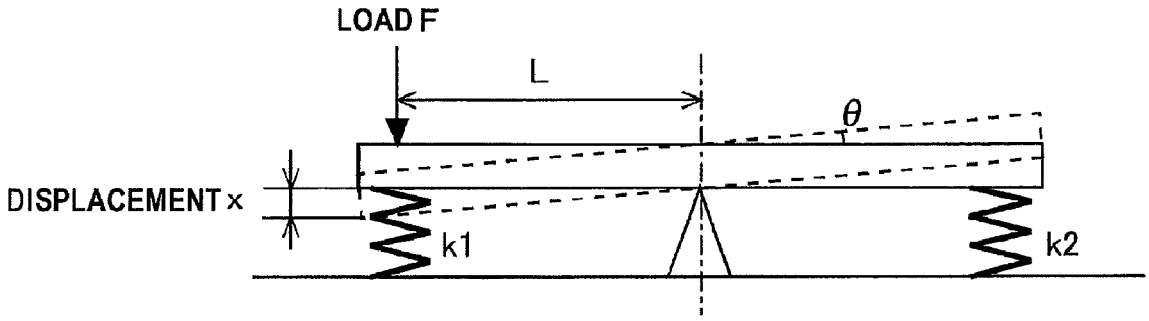
FIG. 12 is a view showing a model in a case of elastically supporting a lower dresser flange with a fulcrum on a center thereof.

FIG. 12 is a view showing a model in the case of elastically supporting the lower dresser flange 41B (and the dresser disk 42) with the fulcrum on the center of the lower dresser flange 41B. A load F is a force applied to a point away from the center of the dresser flange 41B by a distance L, a displacement x is a displacement of an edge of the dresser flange 41B as a result of application of the load F, and kn (n=1, 2, . . . ) is a spring constant of each spring mechanism. In order for the dresser disk 42 to tilt smoothly so as to follow the shape of the polishing pad 10, a spring constant K that can realize an appropriate tilting rigidity is required. In the first to third embodiments, the spring constant K is not less than $0.5\times10^4$ N/m and not more than $2\times10^4$ N/m, or the tilting rigidity Kθ of the dresser disk 42 is not less than 12.5 Nm/rad and not more than 50 Nm/rad. In this specification, the tilting rigidity is defined as a value indicating a relationship between a torque and a rotational displacement (i.e., angle) when a force for causing a rotational motion (i.e., the torque) is applied. The spring constant K in the first and third embodiments represents a spring constant of the plural spring mechanisms 49 in their entireties, and in the second embodiment represents a spring constant of the elastic upper dresser flange 41A in its entirety.

Figure 13:
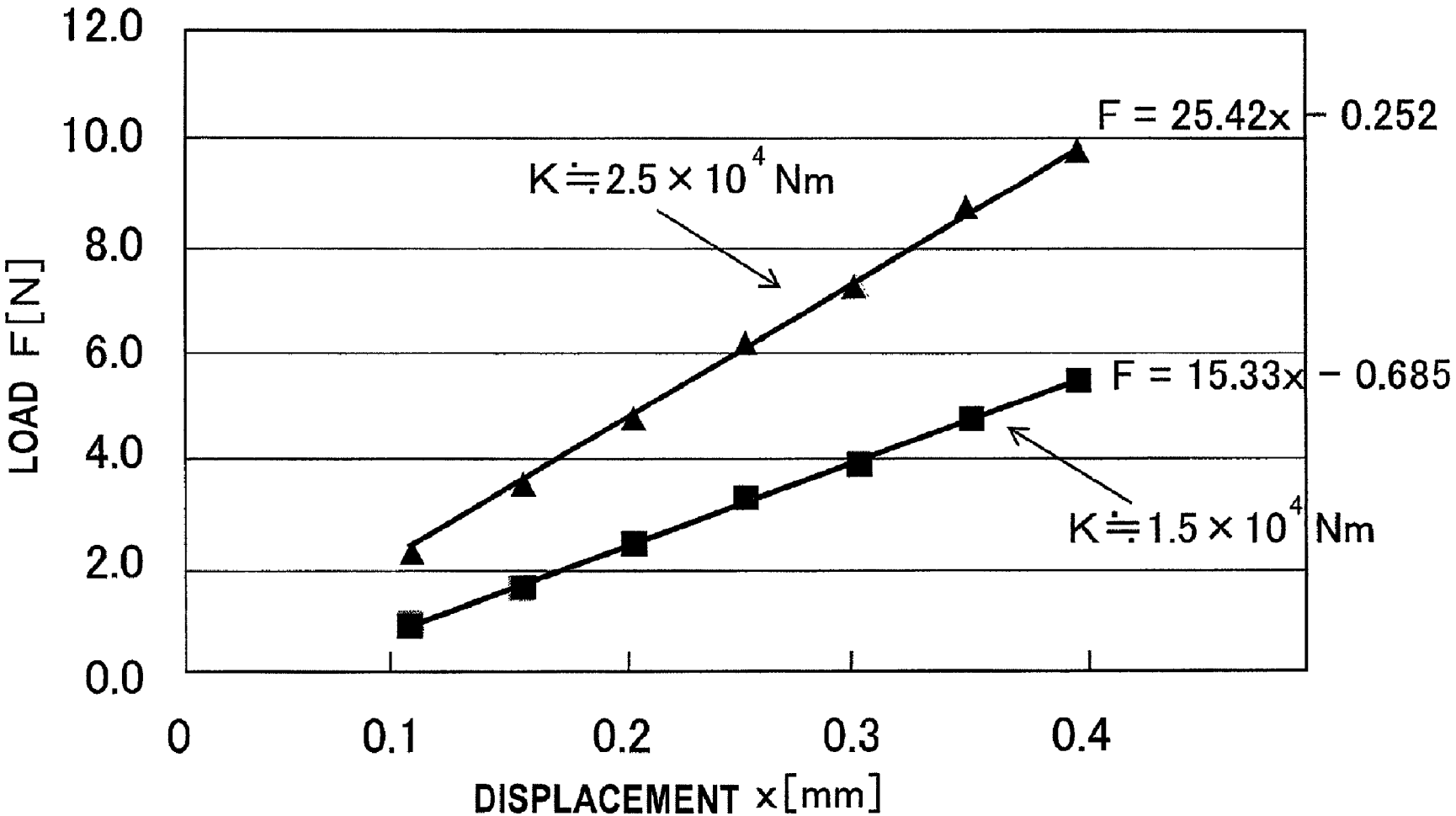
FIG. 13 is a graph showing a relationship between a load F and a displacement x, illustrating that regression lines of dotted points differ based on the difference of a spring constant K.
Figure 14A:
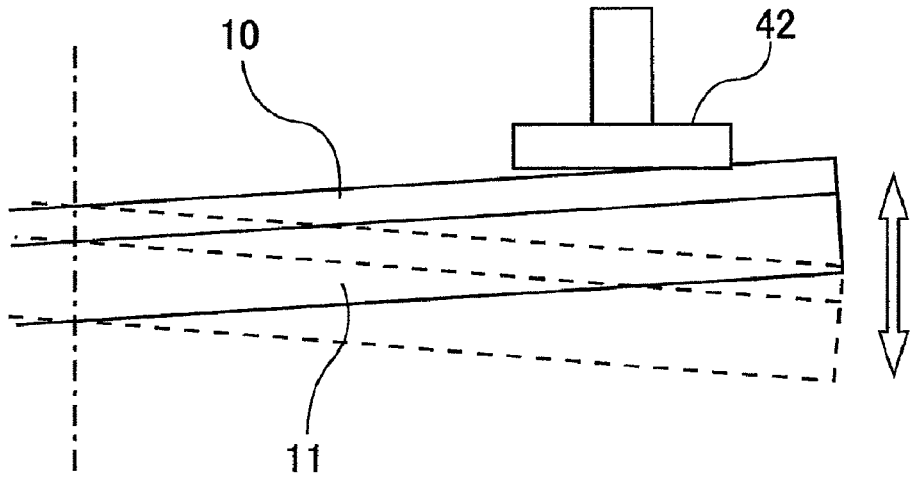
FIG. 14A is a view illustrating a potential problem that might occur when a tilting rigidity of the dresser is far large and the rotating polishing table is too inclined.

FIG. 13 is a graph showing a relationship between the load F and the displacement x that changes according to the spring constant K. A horizontal axis of FIG. 13 is the amount of the displacement as shown in FIG. 12, and a vertical axis of FIG. 13 is the load F (unit: N) against the dresser as described above. Therefore, FIG. 13 shows a relationship between the load F and the displacement x. As shown in FIG. 13, the regression lines of dotted points in the graph differ according to the difference of a spring constant K. FIG. 14A is a view illustrating a problem that can occur when the tilting rigidity is large, and FIG. 14B is a view illustrating a problem that can occur when the tilting rigidity is small.

During dressing of the polishing pad 10, the outermost periphery of the polishing pad 10 fluctuates by up to about 100 μm as the polishing table 11 rotates. Under such conditions, if the tilting rigidity of the dresser disk 42 is large, the dresser disk 42 cannot follow the fluctuation of the polishing pad 10, as shown in FIG. 14A. As a result, the periphery of the dresser disk 42 scrapes the polishing pad 10 locally.

Figure 15A:
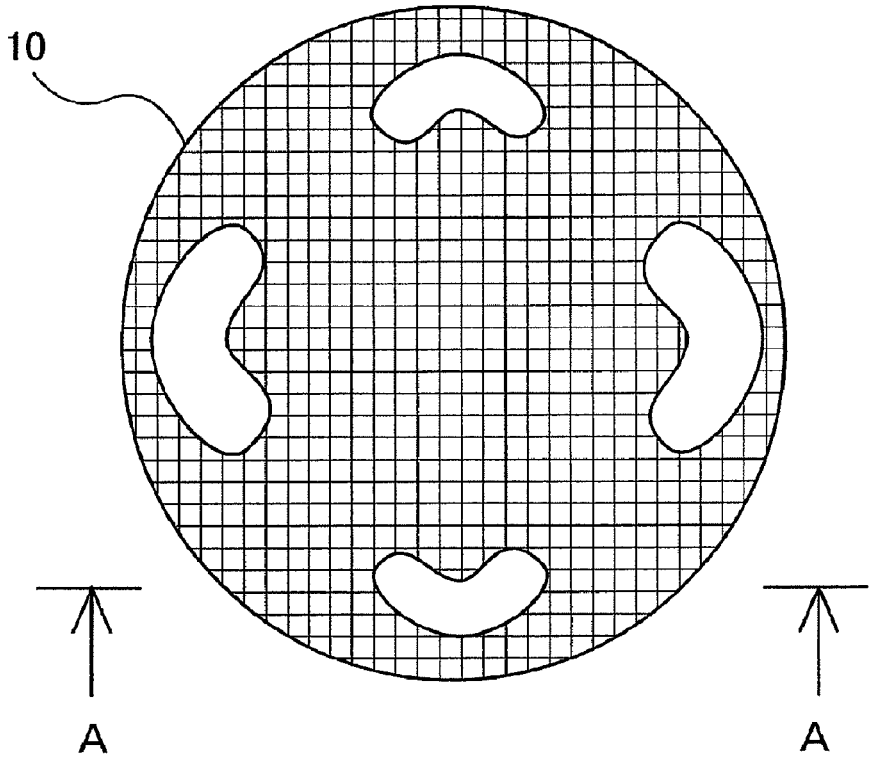
FIG. 15A is a plan view schematically showing a polishing pad that has been scraped by a dresser disk in a case where the spring constant K is larger than $2\times10^4$ N/m (or the tilting rigidity $K\theta$ is larger than 50 Nm/rad)
Figure 15B:
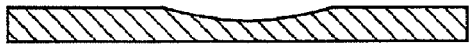
FIG. 15B is a view taken along line A-A in FIG. 15A.
Figure 16A:
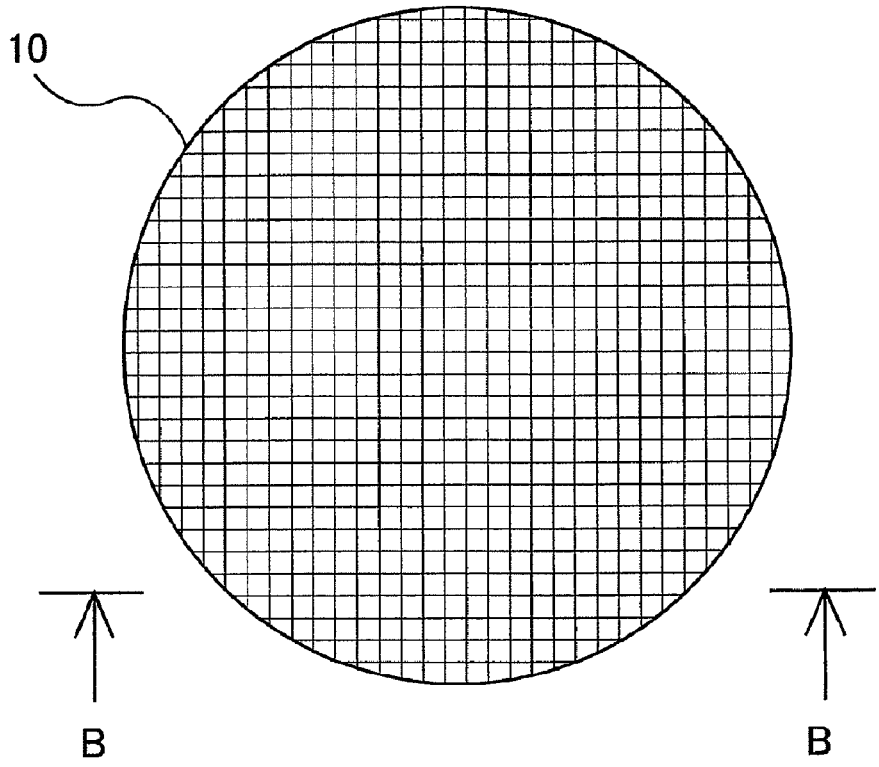
FIG. 16A is a plan view schematically showing a polishing pad that has been scraped by the dresser disk in a case where the spring constant K is not more than $2\times10^4$ N/m (or the tilting rigidity $K\theta$ is not more than 50 Nm/rad)
Figure 16B:
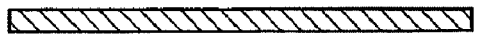
FIG. 16B is a view taken along line B-B in FIG. 16A.

FIG. 15A is a plan view schematically showing the polishing pad that has been scraped by the dresser disk in the case where the spring constant K is larger than $2\times10^4$ N/m (or the tilting rigidity Kθ is larger than 50 Nm/rad), and FIG. 15B is a view taken along line A-A in FIG. 15A. As shown in FIG. 15A and FIG. 15B, when the tilting rigidity of the dresser disk 42 is large, part of the polishing pad 10 is scraped off greatly. On the other hand, FIG. 16A is a plan view schematically showing the polishing pad that has been scraped by the dresser disk in the case where the spring constant K is not more than $2\times10^4$ N/m (or the tilting rigidity Kθ is not more than 50 Nm/rad), and FIG. 16B is a view taken along line B-B in FIG. 16A. As shown in FIG. 16A and FIG. 16B, when the tilting rigidity of the dresser disk 42 is small to some degree, the polishing pad 10 is scraped uniformly.

Figure 14B:
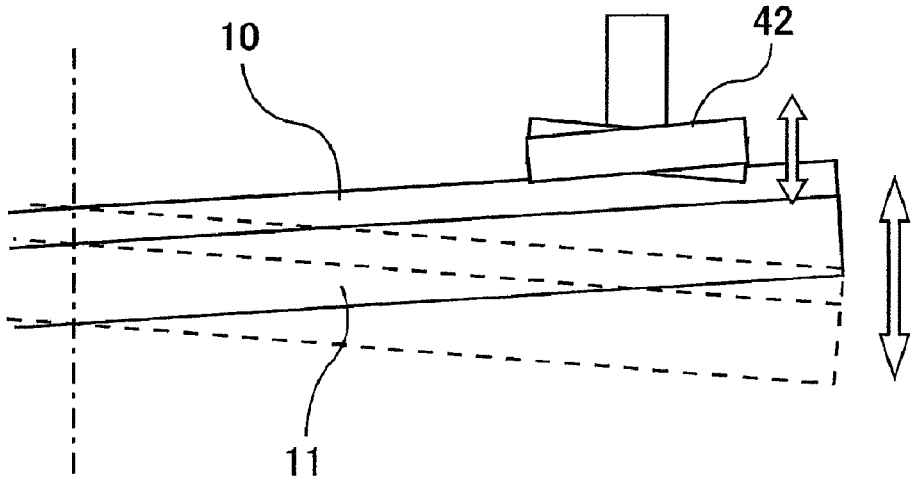
FIG. 14B is a view illustrating a potential problem that might occur when the tilting rigidity of the dresser is far small and the rotating polishing table is too inclined.
Figure 17:
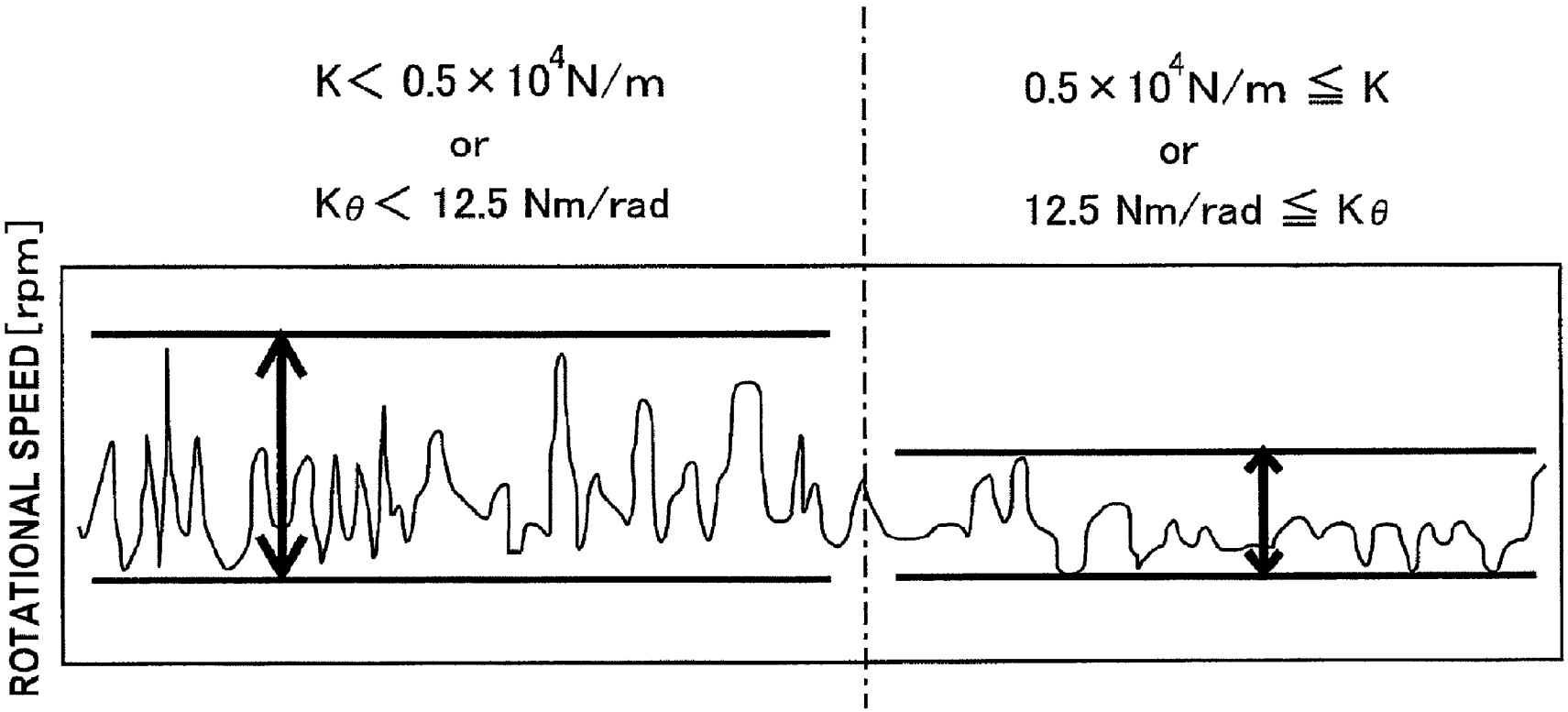
FIG. 17 is a graph showing a variation (an error) in rotational speed of the dresser disk that changes depending on the spring constant or the tilting rigidity.

If the tilting rigidity of the dresser disk 42 is substantially zero and the position of the fulcrum of the tilting motion is high, the dresser disk 42 is easily caught by the polishing pad 10, as shown in FIG. 14B. As a result, a stick slip phenomenon occurs in the tilting motion of the dresser disk 42, and causes a variation (error) in rotational speed of the dresser disk 42. FIG. 17 is a graph showing the variation (error) in rotational speed of the dresser disk that changes depending on the spring constant or the tilting rigidity. As can be seen from FIG. 17, the error of the rotational speed of the dresser disk 42 when the spring constant K is not less than $0.5\times10^4$ N/m or the tilting rigidity Kθ is not less than 12.5 Nm/rad is smaller than that when the spring constant K is smaller than $0.5\times10^4$ N/m or the tilting rigidity Kθ is smaller than 12.5 Nm/rad.

Figure 18:
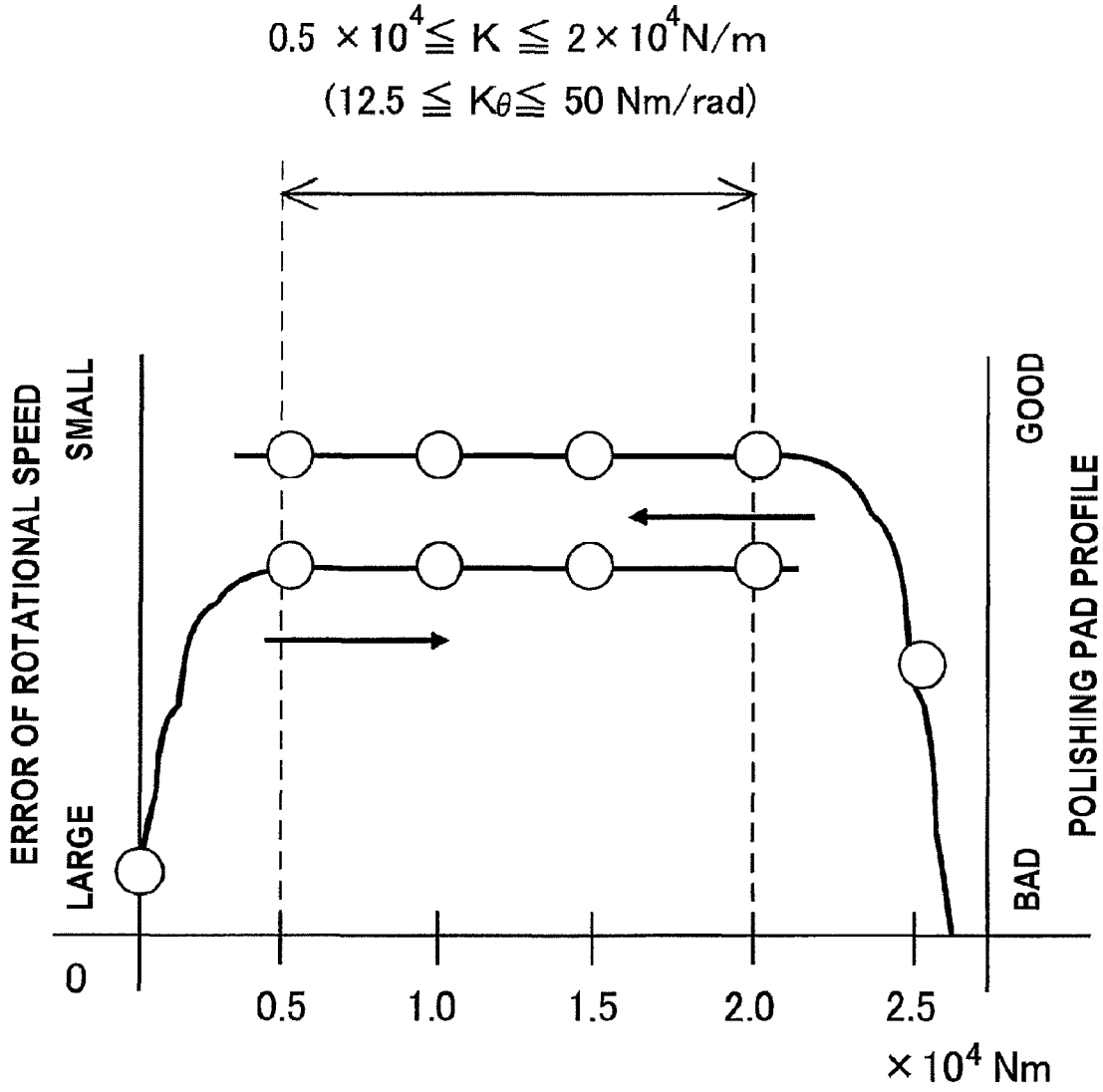
FIG. 18 is a graph showing a relationship between the spring constant and the error of the rotational speed and a relationship between the spring constant and a polishing pad profile.

FIG. 18 is a graph showing a relationship between the spring constant and the error of the rotational speed and a relationship between the spring constant and a polishing pad profile. When the spring constant K is smaller than $0.5\times10^4$ N/m, the tilting rigidity is lowered. As a result, the dresser disk is easily inclined by the force of the moment due to the frictional force generated on the surface of the polishing pad, and the dresser disk is likely to vibrate due to the above-described stick slip phenomenon. This vibration causes the variation (error) in the rotational speed of the dresser disk.

On the other hand, when the spring constant K is larger than $2\times10^4$ N/m, the tilting rigidity is increased. As a result, the periphery of the dresser disk scrapes the polishing pad locally, causing partial wear of the polishing pad. Therefore, in order to dress the polishing pad stably, it is necessary that the spring constant of the spring mechanisms be in the range of $0.5\times10^4$ N/m to $2\times10^4$ N/m (or the tilting rigidity Kθ of the dresser disk 42 be in the range of 12.5 Nm/rad to 50 Nm/rad).

As described above, according to the present invention, the dresser can appropriately dress the polishing pad on the polishing table. Further, because the dressing load can be reduced, an amount of the polishing pad scraped off during dressing can be as small as possible, and hence a life of the polishing pad (or fixed abrasive pad) can be increased. Therefore, a running cost of the chemical mechanical polishing apparatus can be reduced. Further, according to the present invention, since dressing can be performed in a short period of time, the polishing pad profile can be maintained well in a relatively short period of time and a throughput of the chemical mechanical polishing apparatus and method can be improved. In addition, the dresser disk can be easily replaced by removing the bolts or magnets.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. An apparatus for dressing a polishing pad, said apparatus comprising:

a dresser drive shaft which is rotatable and vertically movable;

an upper dresser flange coupled to said dresser drive shaft;

a lower dresser flange to which a dressing member is secured; and a spherical bearing provided between said upper dresser flange and said lower dresser flange, and configured to transmit thrust load from said dresser drive shaft to said lower dresser flange and said dressing member while allowing said dressing member to tilt with respect to said dresser drive shaft, wherein said upper dresser flange is shaped to serve as a flat spring configured to generate a force against a tilting motion of said dressing member.

2. The apparatus according to claim 1, wherein said upper dresser flange has a spring constant in a range of $0.5\times10^4$ N/m to $2\times10^4$ N/m.

3. The apparatus according to claim 1, wherein said upper dresser flange is configured to allow said dressing member to have a tilting rigidity in a range of 12.5 Nm/rad to 50 Nm/rad.

4. The apparatus according to claim 1, wherein said upper dresser flange is made of elastic material.

5. The apparatus according to claim 1, further comprising:

a seal member provided between said upper dresser flange and said lower dresser flange, wherein said spherical bearing is located in a space formed between said upper dresser flange and said lower dresser flange, and wherein the space is sealed by said seal member.

6. The apparatus according to claim 1, wherein said upper dresser flange serves as a torque transmission member configured to transmit a torque of said dresser drive shaft to said dressing member.

7. The apparatus according to claim 1, wherein said dressing member is removably attached to said lower dresser flange.

8. The apparatus according to claim 1, further comprising:

a cover arranged so as to surround at least part of said upper dresser flange.

9. A chemical mechanical polishing apparatus, comprising:

a polishing table for supporting a polishing pad;

a top ring unit configured to press a workpiece against the polishing pad while rotating the workpiece;

a liquid supply device configured to supply a polishing liquid onto the polishing pad; and an apparatus for dressing the polishing pad according to claim 1.

10. A chemical mechanical polishing method, comprising:

polishing a workpiece using a chemical mechanical polishing apparatus according to claim 9.

* * * * *